US009488198B2

(12) United States Patent
Groben et al.

(10) Patent No.: US 9,488,198 B2
(45) Date of Patent: Nov. 8, 2016

(54) DEVICE FOR TRANSFERRING A HYDRAULIC WORKING PRESSURE IN A PRESSURE FLUID FOR ACTUATING HYDRAULIC UNITS OF DEEP-SEA SYSTEMS

(75) Inventors: Martin Groben, Sulzbach (DE); Elmar Betzler, Igel (DE)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 513 days.

(21) Appl. No.: 13/261,696

(22) PCT Filed: Jan. 17, 2012

(86) PCT No.: PCT/EP2012/000166

§ 371 (c)(1),
(2), (4) Date: Sep. 4, 2013

(87) PCT Pub. No.: WO2012/100915

PCT Pub. Date: Aug. 2, 2012

(65) Prior Publication Data

US 2013/0340421 A1 Dec. 26, 2013

(30) Foreign Application Priority Data

Jan. 25, 2011 (DE) ..... 10 2011 009 276

(51) Int. Cl.
*E21B 33/064* (2006.01)
*F15B 15/00* (2006.01)
(Continued)

(52) U.S. Cl.
CPC ..... *F15B 15/00* (2013.01); *E21B 33/064* (2013.01); *F15B 1/24* (2013.01); *F15B 21/006* (2013.01);
(Continued)

(58) Field of Classification Search
CPC ..... E21B 33/064; F15B 1/24; F15B 15/00; F15B 21/006; F15B 2201/32; F15B 2201/405
USPC ..... 166/363
See application file for complete search history.

(56) References Cited

U.S. PATENT DOCUMENTS 4,649,704 A * 3/1987 Marsh ..... E21B 33/0355 60/413
6,202,753 B1 * 3/2001 Baugh ..... E21B 33/0355 166/364

(Continued)

FOREIGN PATENT DOCUMENTS

WO WO 2007/045260 A1 4/2007
WO WO 2007045260 A1 * 4/2007 ..... E21B 33/0355

*Primary Examiner* — Matthew R Buck
(74) *Attorney, Agent, or Firm* — Wenderoth, Lind & Ponack, L.L.P.

(57) ABSTRACT

A device for transferring a hydraulic working pressure in a pressure fluid for pressure actuating hydraulic units of deep sea systems, in particular deepwater wells, includes a first pressure chamber (19) for the pressure fluid, a displaceable piston arrangement (9, 11, 13) for changing the volume of the pressure chamber (19), and at least one second pressure chamber (21) in a cylinder arrangement (1). The surrounding pressure of the deep sea can be applied to the second pressure chamber for a displacement of the piston arrangement (9, 11, 13) generating the working pressure in the first pressure chamber (19). A pressure accumulator (37) is associated with the cylinder arrangement (1). The displaceable separating element (41) of the pressure accumulator separates a chamber (45) connected to the seawater from an actuating chamber (43) containing an actuating fluid and connected to the second pressure chamber (21) to apply the deep sea pressure to the second pressure chamber by the actuating fluid.

13 Claims, 1 Drawing Sheet

(51) Int. Cl.
*F15B 1/24* (2006.01)
*F15B 21/00* (2006.01)

(52) U.S. Cl.
CPC ..... *F15B 2201/205* (2013.01); *F15B 2201/31* (2013.01); *F15B 2201/3152* (2013.01); *F15B 2201/32* (2013.01); *F15B 2201/405* (2013.01)

(56) References Cited

U.S. PATENT DOCUMENTS 6,266,959 B1 * 7/2001 Markwart ..... F15B 1/24 60/414
6,418,970 B1 * 7/2002 Deul ..... E21B 33/064 138/26
7,934,561 B2 * 5/2011 Ormond ..... E21B 19/006 114/264
8,479,774 B2 * 7/2013 Baugh ..... E21B 34/16 138/26
8,726,644 B2 * 5/2014 Nellessen ..... F15B 1/02 60/398
8,833,465 B2 * 9/2014 Kotrla ..... E21B 33/0355 166/358
2003/0037544 A1 * 2/2003 Armstrong ..... E21B 33/0355 60/413
2004/0108008 A1 * 6/2004 Baugh ..... E21B 33/0355 138/31
2005/0155658 A1 * 7/2005 White ..... F16L 55/053 138/31
2008/0245432 A1 * 10/2008 Lenz ..... E21B 33/0355 138/30

* cited by examiner

DEVICE FOR TRANSFERRING A HYDRAULIC WORKING PRESSURE IN A PRESSURE FLUID FOR ACTUATING HYDRAULIC UNITS OF DEEP-SEA SYSTEMS

FIELD OF THE INVENTION

The invention relates to a device for transferring a hydraulic working pressure in a pressure fluid for actuating hydraulic units of deep-sea systems, in particular deep water wells. A first pressure chamber for the pressure fluid, a displaceable piston arrangement for changing the volume of the pressure chamber, and at least one second pressure chamber are present in a cylinder arrangement. The surrounding pressure of the deep sea can be applied to the second pressure chamber for displacing the piston arrangement to generate the working pressure in the first pressure chamber.

BACKGROUND OF THE INVENTION

An ever increasing scarcity of resources demands ever greater efforts for obtaining raw materials and sources of energy. As a result, drilling for oil and gas is conducted at ever greater ocean depths. To ensure the safety of such deep-sea drilling operations, which are implemented from drilling platforms or ships, comprehensive safety installations are provided on the ocean floor that are functionally allocated to the transitional area between the drill hole and drill pipe or delivery pipe. One important system part of the safety standard of such deep-sea drilling applications is the "blow-out preventer" (BOP), a device that causes a quick-closure of the outlet to the drill hole and/or drill pipe and/or delivery pipe, should a hazardous situation occur. To ensure safe functioning thereof, pressure fluid at a correspondingly high working pressure must be reliably provided for the hydraulic actuation.

To avoid the difficulties that must be overcome to convey a pressure fluid that has a sufficiently high working pressure and that is available in a sufficient quantity from a drilling platform or ship on the water's surface to the ocean floor, located correspondingly at a great depth, the prior art (see U.S. Pat. No. 6,418,970 B1) discloses a device of the kind mentioned in the introduction for providing the hydraulic working pressure required for actuating the related deep-sea system in situ. The necessary hydraulic working pressure is generated by utilizing the surrounding pressure of the deep sea, which is the high deep water pressure. Specifically, the surrounding deep water pressure of the deep sea is applied to a piston apparatus inside a cylinder arrangement. The hydraulic pressure is generated by the achieved movement of the piston inside a pressure chamber of the cylinder arrangement.

Despite the advantages that are created due to the generation or in situ transfer of the working pressure, the operating properties of the known device are not satisfactory. The use of seawater for operating the cylinder arrangement poses problems in several regards. On the one hand, a contamination risk exists due to the penetration of sediment particles and the like, or of microorganisms that are introduced together with the seawater. On the other hand, the system is compromised due to the extremely corrosive effect of the seawater. To counteract the corrosion problem, the cylinder arrangement must be suitably lined with, and/or manufactured from, correspondingly corrosion-proof materials to reduce corrosion and/or the elevated friction coefficient with the piston movements due to deposits. Despite these measures, difficulties persist, due to salt water deposits, for example calcium stearate.

SUMMARY OF THE INVENTION

An underlying object of the present invention to provide a device of the type specified that ensures improved operating reliability, while preserving the advantages that are realized from the in situ pressure transfer.

According to the invention, this object is basically achieved with a device, where, contrary to the prior art, the working pressure inside the cylinder arrangement is not generated or transferred by seawater acting directly on the piston arrangement. Instead, a pressure accumulator is disposed upstream of the cylinder arrangement, from which an actuating fluid, subject to the deep-sea pressure, can be supplied to the cylinder arrangement. To this end, the pressure accumulator includes a chamber that is in communication with the seawater and that is separated from the chamber containing the actuation fluid by a displaceable separating element. The pressure accumulator is in communication with the corresponding pressure chamber of the cylinder arrangement to apply the deep-sea pressure to it by the actuating fluid, thereby affecting the displacement of the piston and generating the working pressure. In contrast to the prior art, only one chamber is, therefore, in communication with the seawater that is loaded with the corrosive and possibly problematic materials. Due to the pressure accumulator that is disposed upstream of the cylinder arrangement, the cylinder arrangement proper is separated from the seawater but is, nevertheless subjected to deep-sea pressure applied thereto because the displaceable separating element of the pressure accumulator preloads the actuating fluid with the respectively present deep-sea pressure.

Advantageously, the pressure accumulator can include a separating element that is able to tolerate the effects of seawater. The parts of the pressure accumulator that are disposed upstream and that come in contact with salt water are made of a non-corrosive steel or have a protective coating.

Especially advantageously, a bladder accumulator or a hydro accumulator is provided, equipped with a bladder that is made, for example, of a plastic of synthetic rubber material.

Especially advantageously, a mixture of water and glycol is provided as actuating fluid in the pressure accumulator. That fluid prevents corrosion, reduces friction in the manner of a lubricant and offers, simultaneously, an antifreeze effect that precludes any hazards due to icing, which can occur due to cooling in connection with expansion processes.

If the cylinder arrangement is provided in the form of a dual piston accumulator, the apparatus can advantageously include two cylinder parts, one per piston. The cylinder parts are coaxially disposed relative to each other and separated from each other by a separating body that is disposed therebetween. The two pistons are connected to each other by a piston rod that is routed in a sealed fashion through the separating body that has on both of its sides a pressure chamber. The first and second pressure chambers are disposed, respectively, between the separating body and the one of the pistons.

Moreover, between the piston delimiting the first pressure chamber and the closed end of the related cylinder part, a preload pressure chamber for pressurized gas, such as $N_2$, can be provided. When operating the device, the deep-sea pressure as well as, simultaneously, the preload pressure acting upon the piston arrangement are available for actuating the device.

To allow for virtually unhindered piston displacement to generate the working pressure when the cylinder arrangement is sealed, a low-pressure pressure chamber is preferably disposed between the piston delimiting the second pressure chamber and the closed end of the related cylinder part for a gas, intended for minimally pressurized gas, preferably provided by a vacuum pressure, such as $N_2$.

A pressure container for the gas, that is pressurized with a preload pressure, is connected in especially preferred embodiments to the preload pressure chamber. This way, aside from the gas volume in the preload pressure chamber, the gas volume of the additional pressure container is available for the cylinder arrangement, which supports the piston displacement that occurs for the generation of the working pressure over the entire stroke of the piston.

The pressure container can have a cylindrical pipe body that is disposed parallel to and adjacent to the cylinder parts of the cylinder arrangement. The diameter of the pipe body therein is, preferably, greater than the cylindrical diameter of the cylinder arrangement, such that a relatively large extra gas volume of gas, which is preload-pressurized, is available.

Advantageously, a line can be formed in the end piece, located at the closed end of the preload pressure chamber, that connects, via a bore, respectively, in the associated closed end of the pipe body and in the closed end of the preload pressure chamber, the same to the pressure container.

With regard to the construction of the diaphragm accumulator, advantageously, the apparatus can be configured such that the bladder accumulator or hydro accumulator has an accumulator housing in the form of an oblong accumulator cylinder. The accumulator cylinder is disposed parallel to and adjacent to the cylinder arrangement and extends along the total length of the cylinder part that contains the second pressure chamber.

Other objects, advantages and salient features of the present invention will become apparent from the following detailed description, which, taken in conjunction with the drawings, discloses a preferred embodiment of the present invention.

BRIEF DESCRIPTION OF THE DRAWINGS

Referring to the drawings that form a part of this disclosure.

DETAILED DESCRIPTION OF THE INVENTION

Figure 1:
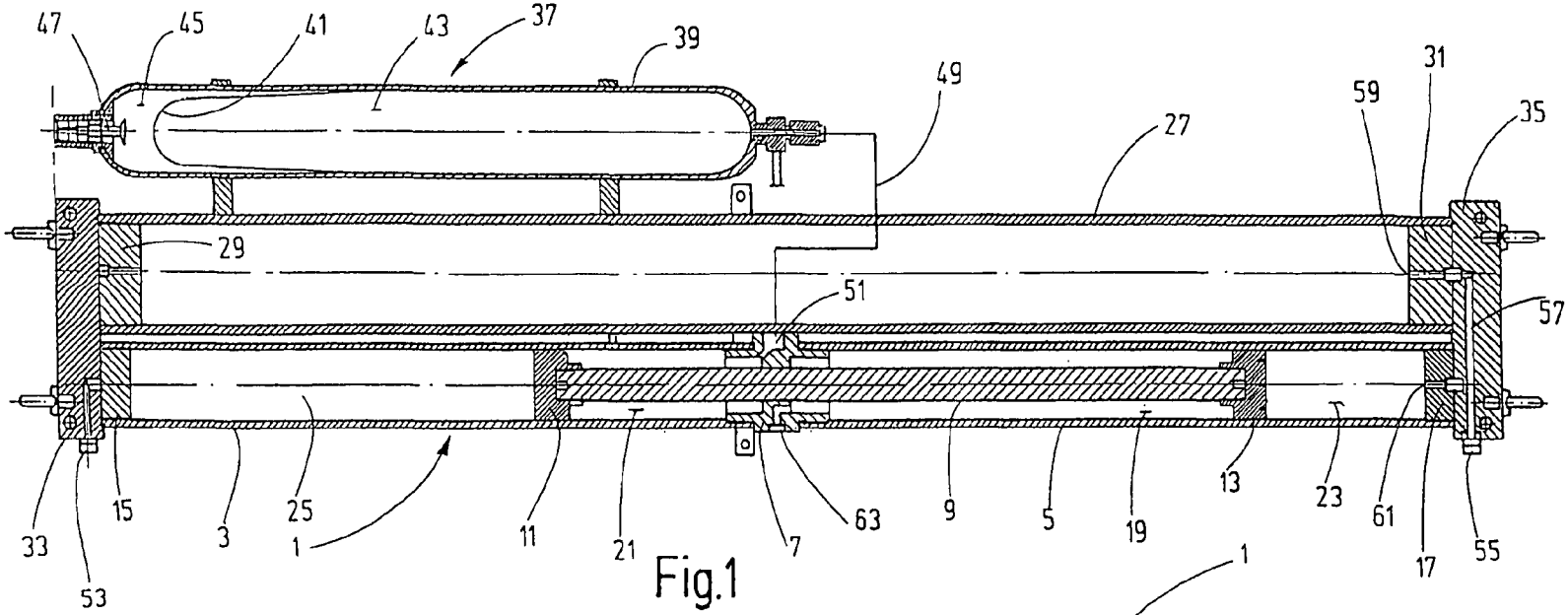
FIG. 1 is a schematically simplified side view in section of a device according to an exemplary embodiment of the invention.
Figure 2:
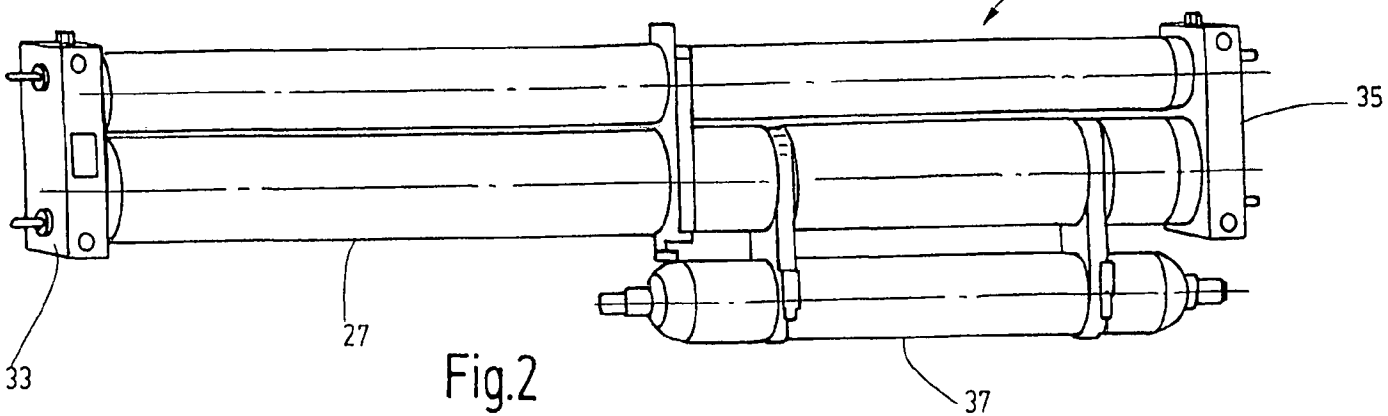
FIG. 2 is a perspective view of the embodiment of FIG. 1, also drawn in a simplified manner.

The embodiment of the device according to the invention that is depicted in the drawing is intended for use in connection with a "blow-out preventer" (BOP) disposed as a safety installation for a deep water well at great ocean depths of, for example, 3,600 meters. In applications of this kind, the device can have a considerable construction size. The cylinder arrangement 1 that constitutes the main part of the device, can, for example, have a length in the range of 4 meters. The cylinder arrangement 1 is designed as a dual piston accumulator, having a first cylinder part 3 and a second cylinder part 5 that are coaxially disposed relative to each other and connected to each other via a separating body 7 that seals a first cylinder part 3 and a second cylinder part 5 from each other. Extending through the separating body 7 is a piston rod 9 that has, on one end thereof, a piston 11 attached thereto and displaceable in the first cylinder part 3, and that has a piston 13 displaceable in the second cylinder part 5 on the opposite end of piston rod 9. The piston rod 9 is routed through the separating body 7 in a sealed fashion. On its end, the cylinder part 3 is closed off by a closure part 15. The cylinder part 5 is closed off by a closure part 17.

With this construction, the cylinder arrangement 1 defines four interior pressure chambers; namely, a first pressure chamber 19 containing the pressure fluid, that is provided for actuating the BOP, and being disposed between the separating body 7 and the piston 13 in the second cylinder part 5. A second pressure chamber 21 is disposed between the separating body 7 and the piston 11 in the first cylinder part 3, and is provided for the actuating fluid that causes the piston displacement by the actuating pressure generated by the surrounding pressure of the deep sea to transfer the working pressure in the first pressure chamber 19. Moreover, a preload pressure chamber 23 is disposed as a third pressure chamber between the closure part 17 of the second cylinder part 5 and the allocated piston 13. A low-pressure chamber 25 is disposed between the closure part 15 of the first cylinder part 3 and the allocated piston 11 and is disposed in the first cylinder part 3 as a fourth pressure chamber.

As shown by the figures, parallel next to, and closely adjacent to the cylinder arrangement 1, there is a pressure container 27 is provided in the form of a cylindrical pipe body that has the same length as the cylinder arrangement 1, but a larger diameter, preferably, double the diameter of the cylinder arrangement. On its ends, the pressure container 27 is closed off by closure parts 29 and 31. The respective closed ends of the cylinder parts 3 and 5 and of the pressure container 27 are aligned flush relative to each other, meaning the closure parts 15 and 29, as well as closure parts 17 and 31, are connected to each other, respectively, by end pieces 33 and 35, respectively. The pressure container chamber 27 is also connected to the preload chamber 23 by the end piece 35.

The device completes a corrosion-proof pressure accumulator 37, in the embodiment in the form of a bladder accumulator or hydro accumulator, having an oblong plastic-coated accumulator housing 39 that extends along the pressure container 27, parallel to, and adjacent to the pressure container 27. Accumulator housing 39 has a length that corresponds or is equal to approximately the length of the adjacent first cylinder part 3. The bladder or diaphragm 41 disposed inside the pressure accumulator 27 as a separating element is made of a material able to tolerate seawater, for example a plastic or elastomer material, dividing the interior space of the pressure accumulator 37 into an actuating chamber 43 and a seawater chamber 45. Seawater chamber 45 is in fluid communication with the surrounding seawater via a check valve 47 that allows water to enter and operates in the manner of a disc valve. The actuating chamber 43 is connected to an actuating input 51 via a pressure line 49 that is in fluid communication with the first pressure chamber 21 via a channel in the separating body 7 of the cylinder arrangement 1.

For operating the device, a low gas pressure, preferably vacuum pressure, is generated in a gas filling ($N_2$) of the low-pressure pressure chamber 25 via connection 53. The accumulator is filled with a mixture of water and glycol, to be used as an actuating fluid that is inside the actuating chamber 43 of the bladder accumulator or hydro accumulator 37. At a water depth of, for example, 3,600 meters and a water pressure of 360 bar in the seawater chamber 45 of the pressure accumulator 37, the second pressure chamber 21 is then preloaded via the line 49 originating from the pressure accumulator 37 and by the actuating fluid until an actuation pressure of 360 bar is reached. Via a preload connection 55 on the end piece 35, which connects the closure parts 17 and 31 to the cylinder part 5 and the pressure container 27, as well as via lines 57 in the end piece 35 and bore holes 59 and 61 in the closure parts 31 and 17, respectively, the pressure accumulator 27, and thereby the preload pressure chamber 23 of the cylinder arrangement 1, are filled with a ($N_2$) gas at a preload pressure. At a preload pressure in the range of 280 bar in the preload pressure chamber 23, the seawater pressure in the second pressure chamber 21 of, for example, 360 bar (3,600 m water depth) and a vacuum pressure in the low-pressure pressure chamber 25, a pressure level of considerably more than 600 bar is then available for the displacement motion by the pistons 11, 13, in FIG. 1 toward the left, to provide the working pressure in the hydraulic fluid contained in the first pressure chamber, which is then also provided at the working output 63 of the separating body 7. Due to the comparatively large volume of the preload gas that is available and due to the reserve volume inside the pressure container 27, the entire stroke path of the piston can be traversed, supported by the preload pressure. Correspondingly, the functioning of the device according to the invention is particularly reliable in terms of operation because, due to the pressure accumulator 37, the seawater is separated from the cylinder arrangement 1. Additionally, the hydraulic working pressure is generated with special efficiency, due to the reserve volume of the preload gas pressure available in the pressure container 27.

While various embodiments have been chosen to illustrate the invention, it will be understood by those skilled in the art that various changes and modifications can be made therein without departing from the scope of the invention as defined in the claims.

The invention claimed is:

1. A device for transferring a hydraulic working pressure for pressure-actuating hydraulic units of deep-sea systems, comprising:

a cylinder having first and second pressure chambers therein, said cylinder including first and second cylinder parts coaxially disposed relative to one another and separated from each other by a separating body between said cylinder parts;

a displaceable piston assembly in said cylinder changing volumes of said first and second chambers by displacement of said piston assembly in said cylinder, said piston assembly including first and second pistons disposed in said first and second cylinder parts, respectively, and being connected to each other via a piston rod extending through and sealed to said separating body, said first pressure chamber being between said second piston and said separating body, said second chamber being between said first piston and said separating body;

a preload pressure chamber being in said second cylinder part and containing a gas under a pressurized preload and being disposed between said second piston and a closed end of said second cylinder part remote from said separating body;

a low-pressure chamber containing a gas pressurized to a low pressure level and being disposed in said cylinder between said first piston and a closed end of said first cylinder part remote from said separating body;

a pressure container being in fluid communication with said preload pressure chamber and containing gas pressurized to a preload pressure; and a pressure accumulator connected to said cylinder, said pressure accumulator having an accumulator housing with a displaceable separating element therein separating a seawater chamber from an actuating chamber inside said accumulator housing, said accumulator housing having an inlet providing fluid communication between surrounding deep-sea water and said seawater chamber, said actuating chamber containing actuating fluid and being in fluid communication with said second pressure chamber applying surrounding deep-sea pressure in said deep-sea chamber to said second chamber via said actuating fluid displacing said piston assembly in said cylinder and generating the working pressure in said first pressure chamber, said cylinder, said pressure container, and said accumulator having parallel longitudinal axes and being closely arranged.

2. A device according to claim 1 wherein said separating element is able to tolerate seawater effects.

3. A device according to claim 1 wherein said pressure accumulator comprises a bladder accumulator or a hydro accumulator.

4. A device according to claim 1 wherein said actuating fluid comprises a mixture of water and glycol.

5. A device according to claim 1 wherein said cylinder comprises a dual piston accumulator.

6. A device according to claim 1 wherein said gas is $N_2$.

7. A device according to claim 1 wherein said gas in said low-pressure chamber is $N_2$.

8. A device according to claim 1 wherein said low pressure level is a vacuum pressure.

9. A device according to claim 1 wherein said pressure container comprises a cylindrical pipe body disposed parallel to and closely adjacent said cylinder.

10. A device according to claim 9 wherein said cylindrical pipe body extends over an entire length of said cylinder; and said closed ends of said first and second cylinder parts are aligned flush with associated closed ends of said cylindrical pipe body and are connected to said associated ends by end pieces.

11. A device according to claim 10 wherein a line extends in said end piece disposed at said closed end of said second cylinder part connecting said preload pressure chamber in fluid communication with said pressure container via a bore hole in said closed end of said second cylinder part and a bore hole in the adjacent one of said associated closed ends of said cylindrical pipe body.

12. A device according to claim 1 wherein said accumulator housing is corrosion resistant, comprises an oblong accumulator cylinder disposed parallel to and adjacent to said cylinder, and extends over a total length of a cylinder part of said cylinder containing said second pressure chamber.

13. A device according to claim 1 wherein said cylinder, said pressure container and said accumulator are fixedly attached to one another.

* * * * *